United States Patent [19]

Bartelmuss

[11] 4,319,957

[45] Mar. 16, 1982

[54] DEWATERING AND SUPPORT BAR FOR PAPERMAKING MESH

[76] Inventor: Heinrich Bartelmuss, 8863 Teufenbach 63, Austria

[21] Appl. No.: 170,655

[22] Filed: Jul. 21, 1980

Related U.S. Application Data

[63] Continuation of Ser. No. 963,285, Nov. 24, 1978, abandoned.

[51] Int. Cl.[3] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| Re. 29,417 | 9/1977 | Lee et al. | 162/352 X |
| 3,425,901 | 2/1969 | Koffskey, Jr. | 162/352 |
| 3,576,716 | 4/1971 | Reynolds et al. | 162/352 |
| 4,047,903 | 9/1977 | Bartelmuss | 156/89 |
| 4,088,531 | 5/1978 | Lamminen | 162/352 |
| 4,164,442 | 8/1979 | Bartelmuss | 162/352 |

FOREIGN PATENT DOCUMENTS

| | | | |
|---|---|---|---|
| 302800 | 10/1972 | Austria . | |
| 311783 | 12/1973 | Austria . | |
| 949979 | 9/1956 | Fed. Rep. of Germany | 162/352 |
| 2229509 | 1/1973 | Fed. Rep. of Germany | 162/352 |
| 2650343 | 4/1977 | Fed. Rep. of Germany | 162/352 |
| 6805408 | 10/1968 | Netherlands | 162/352 |

*Primary Examiner*—Richard V. Fisher
*Attorney, Agent, or Firm*—Karl F. Ross

[57] ABSTRACT

A papermaking machine has a dewatering mesh that passes over and is supported by a plurality of parallel dewatering bars extending transversely of the displacement direction of the mesh. Each bar has an elongated ceramic upper surface formed with a sharp front edge directed into the mesh displacement direction and each bar is carried on and displaceable along a transversely extending support guide so that it can be drawn transversely out from underneath the mesh and can be reinserted transversely thereunder. The upper surface and the sharp front edge of the bar are rounded at one end of the bar so that this bar can be displaced transversely under the mesh with this one end out of contact with the mesh during the operation of the machine and passage of the mesh over the sharp edge of the guide bar.

8 Claims, 17 Drawing Figures

FIG. 12
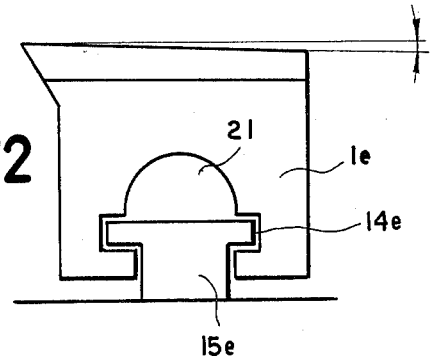
FIG. 13
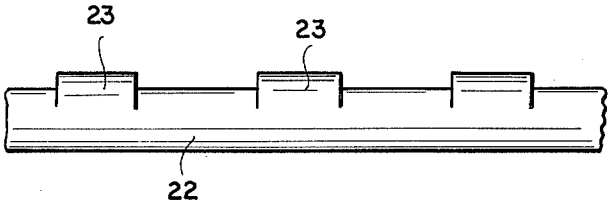
FIG. 14
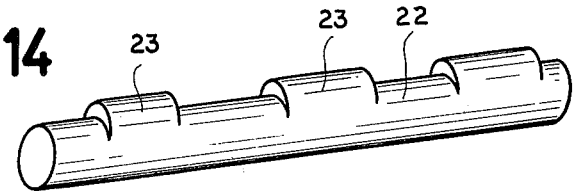
FIG. 15
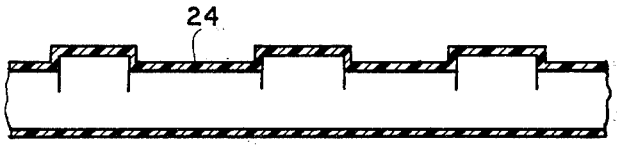
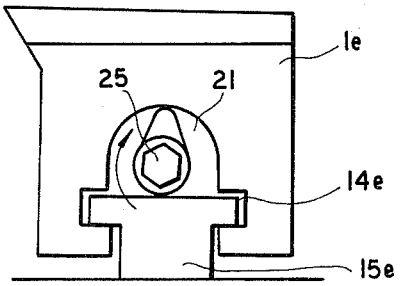
FIG. 16
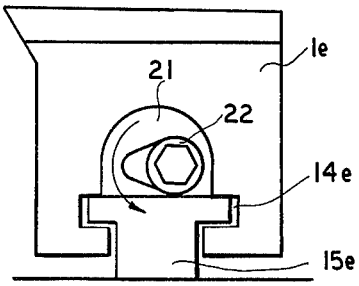
FIG. 17

DEWATERING AND SUPPORT BAR FOR PAPERMAKING MESH

This is a continuation of application Ser. No. 963,285, filed Nov. 24, 1978, now abandoned.

FIELD OF INVENTION

The present invention relates to a dewatering and support bar for a papermaking mesh. More particularly this invention concerns such a bar which is normally provided between the breast roll and suction boxes of a Fourdrinier-type papermaking machine.

BACKGROUND OF THE INVENTION

In the making of paper a suspension of fibers, size, and water is poured as a wide band onto a continuously moving mesh also known as a Fourdrinier wire. This mesh is normally made of bronze and is extremely fine, in fact so fine that light can scarcely pass through it, so that the solid phase of the suspension will remain on the mesh while the liquid phase—the water—will drop through it.

In most systems the mesh is supported at the upstream end, the so-called wet end of the process, by means of transversely extending bars, also known as foils, having sharp edges directed forwardly into the direction of travel of the screen. These bars serve for dewatering of the paper being formed on the screen in its preliminary stages of production. To this end their leading edges must be very sharp for clean stripping of the moisture from the underside of the mesh. These upper surfaces of the bars are normally made of extremely hard material, such as a silicate, as described in my U.S. Pat. No. 4,047,993 and in my copending application Ser. No. 807,330 filed June 16, 1977 (now U.S. Pat. No. 4,164,442).

Even though the upper surface of these bars which are in contact with the normally bronze mesh are of such extremely hard material, it is nonetheless necessary occasionally to withdraw and either replace or clean the bars. For this purpose it is known to mount the bars on transversely extending guides so that the bars can be pulled transversely out from underneath the mesh. During this operation the entire machine is usually shut down so as to be able to lift the mesh off the bar or bars being replaced. It is normally considered unthinkable to displace the bars with their sharp edges out from underneath the mesh while the machine is in operation because this could easily damage the mesh which as a result of its fineness, extreme length in the neighborhood of several hundred meters, and material, is an extremely expensive item that can cost several thousand dollars. Thus the servicing of these dewatering and support bars represents a considerable bottleneck in the papermaking process.

Other prior-art systems are seen in Austrian Pat. Nos. 302,800 and 311,783 as well as in German Pat. No. 949,979 and in U.S. Pat. No. 3,576,716.

OBJECTS OF THE INVENTION

It is therefore an object of the present invention to improve on the known papermaking machines.

Another object is to improve on the dewatering and support bar described in my above-cited patent and patent application.

Yet another object is to provide a support bar which can be serviced without having to shut down the entire papermaking machine.

SUMMARY OF THE INVENTION

These objects are attained according to the instant invention in a dewatering and support bar of the above-described general type wherein at least one end of the bar is rounded, both on its upper surface and at its sharp leading edge. Thus with the system according to the instant invention it is possible to withdraw a single bar of a group of bars in a papermaking machine during operation of the machine to service it, and to replace it while the machine is still running. The rounded end of the bar prevents a sharp corner or edge of it from cutting into and destroying the mesh as the bar is being withdrawn or reinserted. This simple expedient therefore allows the bars to be cleaned or otherwise serviced without having to shut down the entire machine, so that not only can a considerable saving in production time be realized, but such servicing of the dewatering and support bars can be carried out at more regular intervals than has hitherto been considered practical so as to make a high-quality paper.

According to this invention the bar is formed with a substantially planar top face that meets a substantially planar front and back face at front and rear edges. The front end is, as mentioned above, sharp and serves for stripping water from the underside of the mesh traveling over the bar. At the one rounded end the top face is rounded downwardly, the front face is rounded backwardly, and the rear face is rounded forwardly. Thus a completely blunt end is formed on the bar which nonetheless has sharp edges once installed fully under the mesh. According to this invention the round end of the bar is positioned to extend slightly beyond the far edge of the mesh when in use. Except at its rounded end the bar upper surface is formed as a family of parallel lines, but is rounded inwardly at this family of lines at the end.

According to other features of this invention the bar and its guide or support are formed with an interfitting ridge and groove both of substantially regular cross section. The groove may be of dovetail shape, or of T-section, with the ridge complementarily formed. When the grooves are formed in the bar one side of this groove may be formed by a deflectable member, displaceable through at least 0.5 mm, and serving either to unclamp and allow sliding of the bar, or to allow the bar to be lifted completely off the guide. It is also possible to provide in the bar a rod having a plurality of cam-type lobes each engageable at the top of the T-section ridge of the guide or against the bar, so that this rod can be rotated to force the lobes downwardly against the ridge or upwardly against the bar and lock the bar tightly in place. Normally the mesh bears downwardly on the bar with the force of at least 5 grams per centimeter of length of the bar in the direction transverse to the direction of displacement of the mesh.

BRIEF DESCRIPTION OF THE DRAWING

FIGS. 5–12 are end-views of bars in accordance with this invention;

FIGS. 13 and 14 are side and end perspective views of a detail of a bar assembly according to this invention;

FIG. 15 is an axial section through the rod shown in FIG. 14; and

FIGS. 16 and 17 are end views of the bar assembly employing the structure of FIG. 13–15 in the locked and released position, respectively.

SPECIFIC DESCRIPTION

Figure 1:
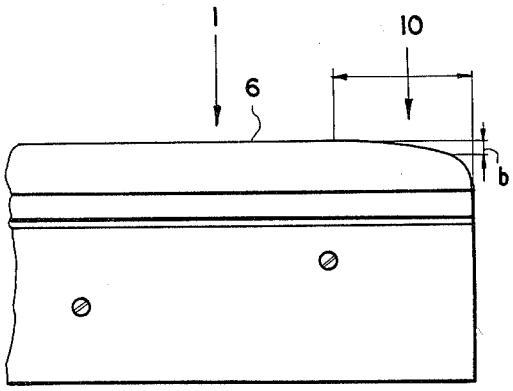
FIGS. 1, 2 and 3 are front, end, and top elevational views, respectively, of the bar according to this invention.
Figure 2:
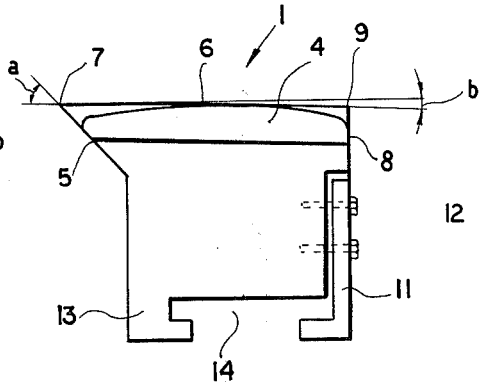

As shown in FIGS. 1–6 a support and dewatering bar 1 according to this invention is carried on a guide (FIGS. 5 and 6) and extends longitudinally perpendicular to a direction D in which a mesh 3 is displaced at high speed. The bar 1 has a ceramic cap 4 manufactured in accordance with the method described in my above-cited patent and copending patent application. This bar 1 is formed with a planar front face 5, a planar top face 6 forming a sharp edge 7 with the face 5, and with a planar rear face 8 forming a sharp rear edge 9 with the top face 6. The top face 6 forms an angle a of approximately 42° with the front face 5 and forms an angle b of approximately 3° with the horizontal along which the mesh 3 is displaced.

Figure 3:
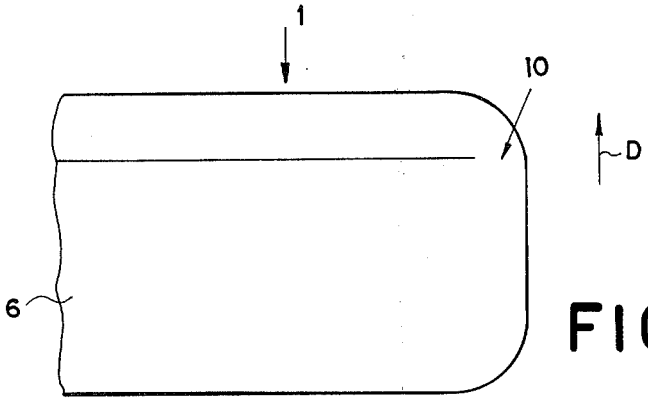
Figure 4:
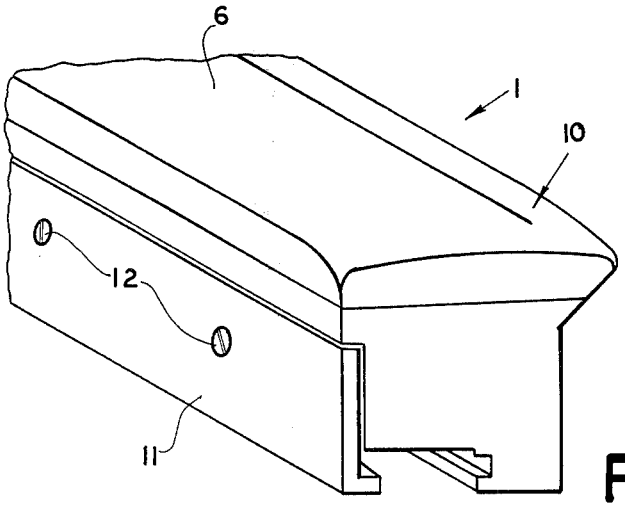
FIG. 4 is a rear perspective view of the bar of this invention.

At one end 10 of the bar 1 the top face 6 is rounded downwardly and the front face 5 and rear face 8 are rounded toward each other horizontally. Thus the entire end 10 is rounded. A slope of at least 1:1000 is used for the rounding as seen in FIG. 3. The rounding of the front and rear faces is carried out on a center so that seen from the top the end 10 is part-circular.

Figure 5:
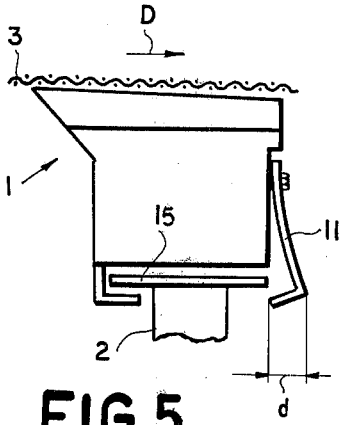
Figure 6:
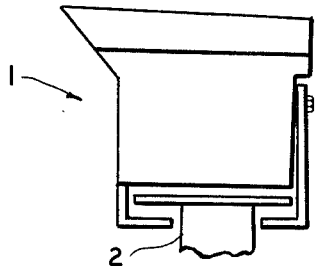

The rear side of the bar has a member 11 secured by screws 12 and forming with a downwardly extending front lip 13 of the bar 1 a T-section groove or slot 14 that embraces a T-section ridge or formation 15 on the guide or support 2. As shown in FIGS. 5 and 6 the lower screws 12 can be loosened or removed to pivot the strip 11 outwardly through a distance d equal to at least 0.5 mm, for loosening or freeing of the two parts 1 and 2 from each other. The front lip 13 extends downwardly from the bar 1 by a distance equal to at least one-tenths of the overall height of the bar 1. In addition the surfaces are finished and fitted together at the formations 14 and 15 in accordance with DIN (German industrial standard) 777 and 778.

The bar 1 can therefore be slipped perpendicular to the direction D under the mesh 3 while same is being moved at high speed in the direction D. Neither the sharp edge 7 nor the sharp edge 9 will dig into the mesh 3 as the leading end 10 of the bar 1 is rounded. In this manner one of several such parallel bars 1 can be withdrawn from underneath the mesh 3 during operation of the machine for cleaning, replacing, or other servicing, without having to shut down the machine as in all prior-art systems.

Figure 7:
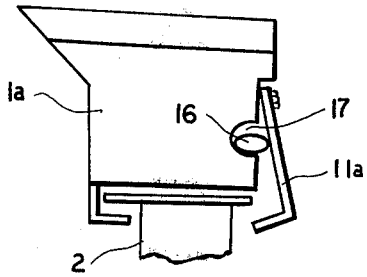
Figure 8:
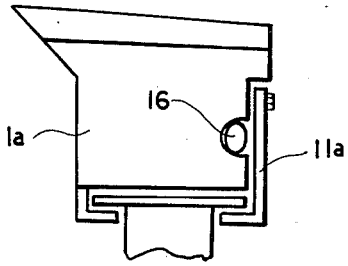

FIGS. 7 and 8 show a system similar to that of FIGS. 1–6, but wherein a bar 1*a* is provided with a strip 11*a* that can be pivoted by means of an eliptical-section rod 16 received in a groove 17 at the back of the bar 1*a*. Thus rotation of this member 16 will cam the strip 11*a* backwardly to loosen the bar 1*a* from the support 2.

Figure 9:
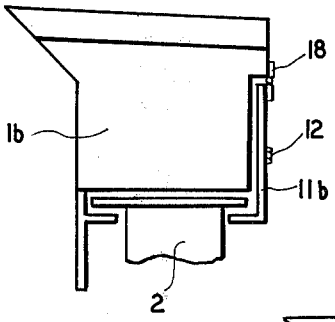

In FIG. 9 another arrangement is shown wherein the strip 11*b* is held at its upper edge by means of a hinge 18, so that releasing of the screws 12 allows the strip 11*b* to be swung up.

Figure 10:
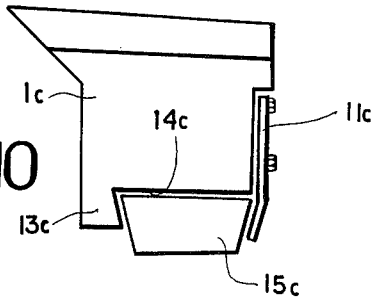

In FIG. 10 the bar 1*c* forms a downwardly open dovetail 14*c* in which a dovetail guide formation 15*c* is receivable. The rear strip 11*c* embraces the dovetail guide 15*c* with a correspondingly shaped front lip 13*c* of the bar 1*c*.

Figure 11:
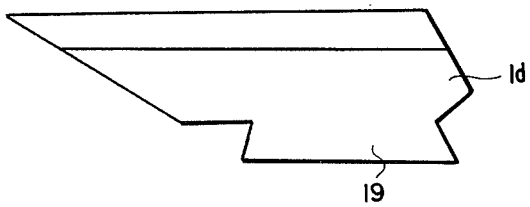

In FIG. 11 a bar 1*d* is shown having at its lower edge a dovetail ridge 19 receivable in a complementary dovetail groove of a support and guide bar (not shown).

In FIGS. 12–17 a bar 1*e* is shown which is substantially identical to that of FIGS. 1–6, with a T-section slot 14*e* in which a T-section guide rail 15*e* is received. In addition the bar 1*e* is formed above the groove 14*e* with a semi-cylindrical downwardly concave recess 21 in which is received a rod 22 having a plurality of cam lobes 23 and covered with an elastic cushioning coating 24. This rod 22 is rotatable inside the recess 21 and has at its one end a socket 25 shaped to receive an Allen wrench. Thus when rotated from the position of FIGS. 17 to the position of FIG. 16 its lobes 23 will bear against the recess 21 and will lift the bar 1*e* slightly, locking it in place on the T-section guide bar 15*e*. It would also be possible to rotate the lobes 23 into contact with the upper surface of the T-rail 15*e*.

With the system in accordance with the instant invention it is therefore possible to withdraw and service the guide bar underneath the mesh even while the papermaking machine is operating. As the one end of the rail is rounded such transverses sliding off the rail during its insertion and withdrawal will not bring a sharp pointed edge into contact with the mesh, potentially cutting it. Thus the expensive down time which was necessary to service the prior-art systems is eliminated.

I claim:

1. In a papermaking machine wherein a dewatering mesh passes over and is supported on at least one dewatering bar extending transversely of the displacement direction of said mesh and having an elongated ceramic upper surface formed with a substantially planar top face meeting a front face at an acute angle at a front edge directed into said displacement direction, and wherein said bar is carried on and displaceable along a transversely extending support guide so that it can be drawn transversely out from underneath said mesh and can be reinserted transversely thereunder, the improvement wherein:

said upper surface and said edge are rounded inwardly from said faces at one end of said bar, whereby said bar can be displaced transversely under said mesh with said one end in contact therewith during displacement of said mesh without cutting said mesh; and said bar and said guide being respectively formed with an interfitting T-section groove and ridge, said bar being provided with a rod parallel to said groove and having at least one lobe, said rod being pivotal between a position with said lobe bearing downwardly on said ridge and a position out of engagement with said ridge.

2. The improvement defined in claim 1 wherein said rod is formed with a plurality of generally equispaced such lobes.

3. The improvement defined in claim 1 wherein said rounded end tapers off from the rest of said surface at a slope of at least 1:1000.

4. The improvement defined in claim 3 wherein said bar has a substantially planar front face and a substantially planar top face meeting said front face at an acute angle at said front edge.

5. The improvement defined in claim 1 wherein said groove is downwardly open and is formed on said bar, said bar having a removable strip forming one side of said groove.

6. The improvement defined in claim 5 wherein said bar is integrally formed with a downwardly projecting lip forming the other side of said groove.

7. The improvement defined in claim 1 wherein said bar has a substantially planar rear face meeting said top face at a sharp rear edge, both of said edges being rounded at said one end.

8. The improvement defined in claim 1 wherein said front face is rounded back in said direction and said top face is rounded down at said one end.

* * * * *